US008016577B2

(12) United States Patent
Moorman

(10) Patent No.: US 8,016,577 B2
(45) Date of Patent: Sep. 13, 2011

(54) VANE PUMP WITH VANE BIASING MEANS

(75) Inventor: Steven P. Moorman, Dexter, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 477 days.

(21) Appl. No.: 12/193,507

(22) Filed: Aug. 18, 2008

(65) Prior Publication Data

US 2010/0040464 A1 Feb. 18, 2010

(51) Int. Cl.
*F03C 4/00* (2006.01)
*F04C 18/00* (2006.01)
*F04C 2/00* (2006.01)

(52) U.S. Cl. ..... 418/258; 418/133; 418/266

(58) Field of Classification Search ..... 418/258, 418/259, 266–268, 133, 144
See application file for complete search history.

(56) References Cited

U.S. PATENT DOCUMENTS

| | | | | | |
|---|---|---|---|---|---|
| 2,632,399 | A | * | 3/1953 | Hyre | 418/258 |
| 2,873,826 | A | * | 2/1959 | Werner | 418/258 |
| 2,918,877 | A | * | 12/1959 | Woodcock | 418/258 |
| 3,473,478 | A | * | 10/1969 | Little, Jr. | 418/258 |
| 3,904,327 | A | * | 9/1975 | Edwards et al. | 418/258 |
| 3,967,466 | A | * | 7/1976 | Edwards | 62/91 |
| 4,470,780 | A | * | 9/1984 | Broyden | 418/258 |

FOREIGN PATENT DOCUMENTS

| | | | |
|---|---|---|---|
| DE | 3436180 | | 4/1986 |
| DE | 69502528 | | 6/1998 |
| GB | 2287755 | A * | 9/1995 |

* cited by examiner

*Primary Examiner* — Theresa Trieu

(57) ABSTRACT

A self-priming vane pump includes a cylindrical rotor disposed in a cavity in a housing including inlet and outlet ports. The rotor defines a plurality of axially extending slots which each receive one of a like plurality of vanes. A garter spring or similar resilient annulus is disposed within the rotor and provides a radially outwardly directed force on the vanes which maintains their contact with the cavity walls during pump start-up and rapidly self-primes the pump. The spring or annulus rests against a shoulder within the hollow rotor and is retained therein by a pressed in collar.

16 Claims, 3 Drawing Sheets

VANE PUMP WITH VANE BIASING MEANS

FIELD

The present disclosure relates to vane pumps and more particularly to a self-priming vane pump.

BACKGROUND

The statements in this section merely provide background information related to the present disclosure and may or may not constitute prior art.

Gear pumps and gerotor pumps are often the preferred choice for a fixed or positive displacement pump in applications requiring flows and pressures of low to medium nominal values. One drawback of such pumps, however, is their efficiency. Due to their construction, there is backflow or leakage through the meshing rotors and around the ends of the rotors when they are operating which results in reduced forward flow and thus reduced pumping efficiency.

Fixed displacement vane pumps perform in the same flow and pressures ranges and exhibit improved efficiency due to reduced leakage and backflow. Such reduced leakage and backflow are the result of better sealing between the outer edges of the vanes and the walls of the rotor cavity. However, since contact between the pump vanes and pump cavity and thus the seal quality is primarily the result of centrifugal force and line pressure acting on the center of the rotor, both of which push the vanes outward to seal on the wall of the pump cavity, the seal quality improves with higher rotational speeds and higher line pressure and degrades with lower speeds and lower line pressure. This aspect of vane pump operation is especially problematic at startup of an unprimed pump. Since at startup, the pump will typically be operating at reduced speed and zero pressure, seal quality is low and this problem in exacerbated by the unprimed state of the pump such that establishment of priming and delivery of pressurized fluid may take an undesirably long period of time.

The present invention provides a solution to the dual problems of startup of an unprimed vane pump.

SUMMARY

The present invention provides a self-priming fixed displacement vane pump. The pump includes a hollow cylindrical rotor disposed in an elliptical cavity in a housing including inlet and outlet ports. The rotor defines a plurality of axially extending slots which each receive one of a like plurality of vanes. A garter spring or similar resilient annulus is disposed within the rotor and provides a radially outwardly directed force on the vanes which maintains their contact with the cavity walls during pump start-up and rapidly self-primes the pump. The spring or annulus rests against a shoulder within the hollow rotor and is retained therein by a pressed in collar.

It is thus an object of the present invention to provide a self-priming vane pump.

It is a further object of the present invention to provide a fixed displacement self-priming vane pump.

It is a still further object of the present invention to provide a vane pump having a spring which urges the pump vanes into contact with the wall of the pump cavity.

It is a still further object of the present invention to provide a vane pump having a garter spring disposed within the pump rotor which urges the pump vanes into contact with the wall of the pump cavity.

It is a still further object of the present invention to provide a vane pump having a resilient annulus disposed within the pump rotor which urges the pump vanes into contact with the wall of the pump cavity.

It is a still further object of the present invention to provide a self-priming vane pump having a spring disposed within the pump rotor and retained by a collar which urges the pump vanes into contact with the wall of the pump cavity.

Further objects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
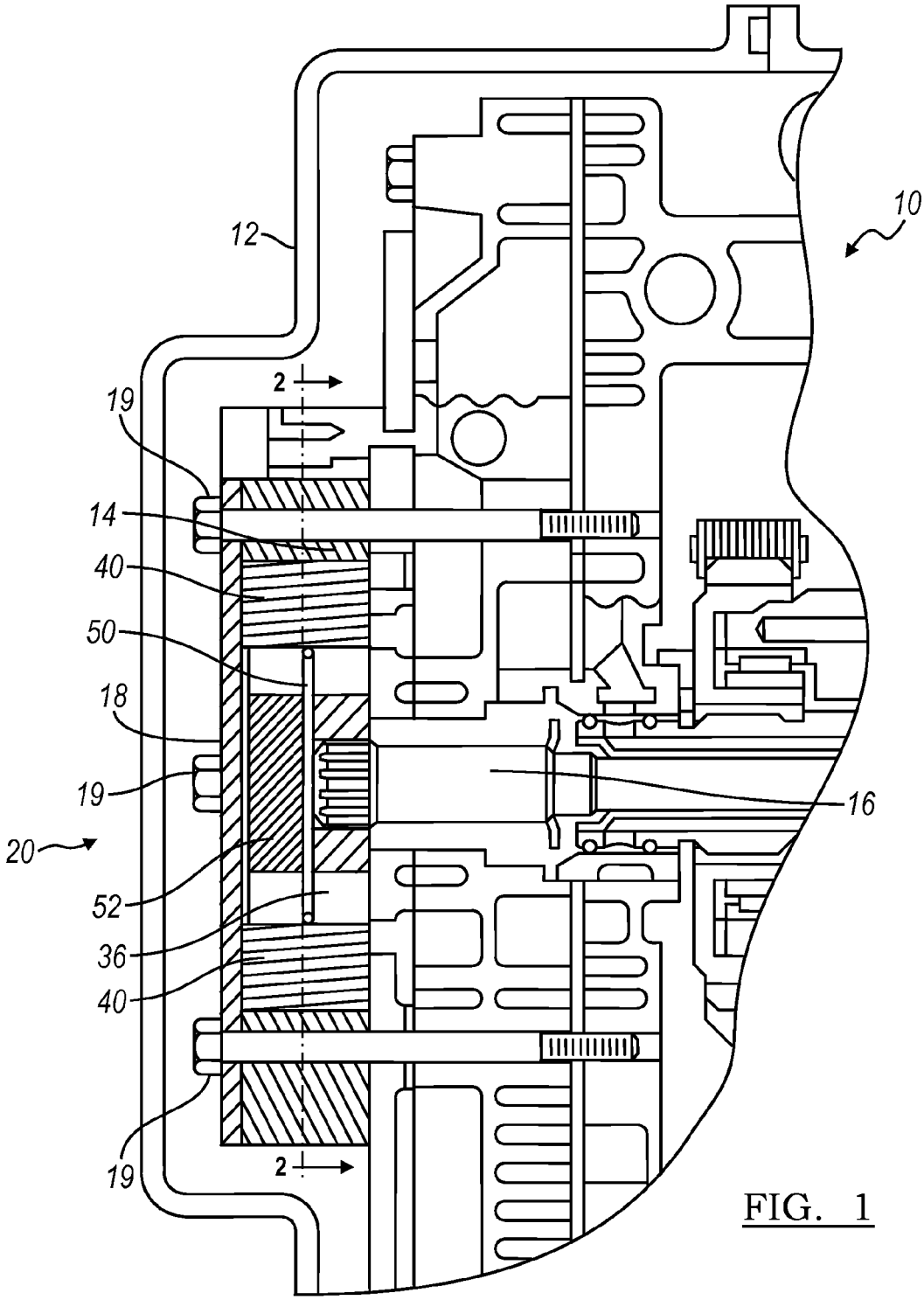
FIG. 1 is a full sectional view of a self-priming vane pump according to the present invention disposed in an automatic transmission.

With reference to FIG. 1, a portion of an automatic transmission incorporating the present invention is illustrated and generally designated by the reference number 10. The automatic transmission 10 includes a housing 12, a portion of which is illustrated in FIG. 1. The housing 12 encases and protects various components of the automatic transmission 10 such as a vane pump housing 14 and a drive shaft 16 which is supported in the vane pump housing 14. A front plate 18, retained by suitable fasteners such as bolts 19, closes off the front of the vane pump housing 14. The drive shaft 16 drives a vane pump 20 incorporating the present invention. The vane pump 20 draws hydraulic fluid or oil from a sump (not illustrated) within the transmission housing 12 and provides such hydraulic fluid or oil under pressure to the various control circuits and devices (not illustrated) of the automatic transmission 10 as well as to the bearings, clutches and brakes (also not illustrated) to lubricate and cool them.

Figure 2:
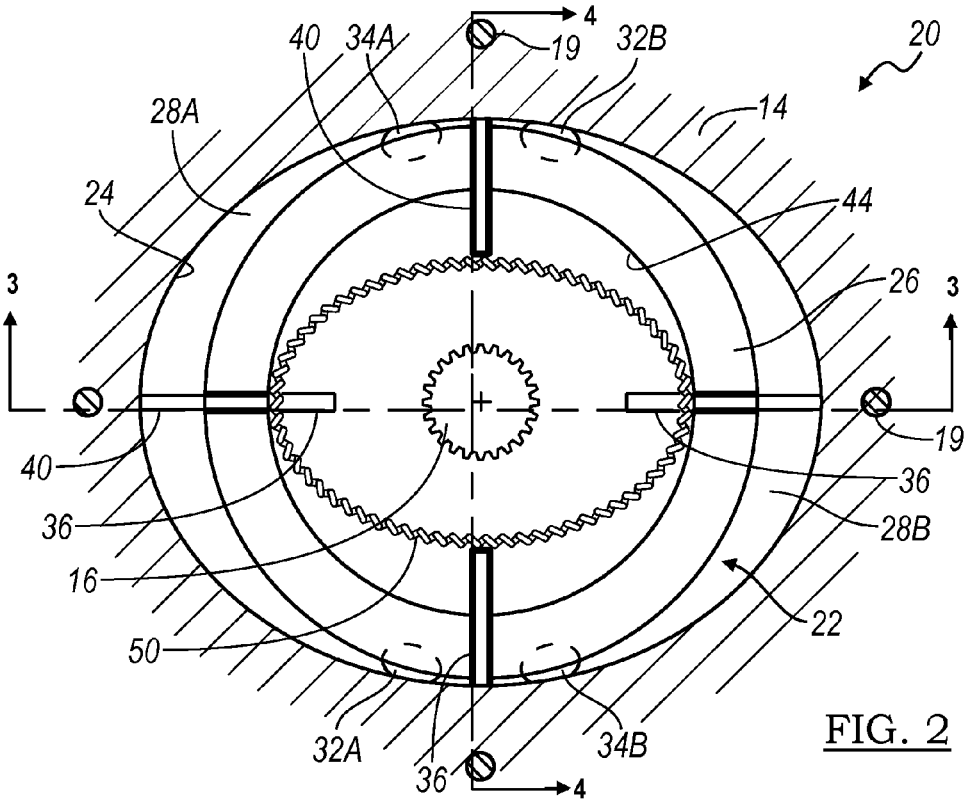
FIG. 2 is an end view of a self-priming vane pump according to the present invention.

Referring now to FIG. 2, the vane pump 20 includes, as noted, a housing 14 which includes an elliptical or oval pump cavity 22 defined by an elliptical or oval wall 24. It should be appreciated that wall profiles other than elliptical or oval may also be utilized. Centrally disposed for rotation within the pump cavity 22 is a hollow cylindrical pump rotor 26. The pump cavity 22 is thus defined by the outer surface of the pump rotor 26 and the elliptical or oval wall 24 and therefore takes the shape of two opposed and symmetrical arcuate or crescent like first and second pumping chambers 28A and 28B. Adjacent the two regions where the first and second pumping chambers 28A and 28B are the narrowest, are disposed a plurality of ports which provide fluid communication into and out of the chambers 28A and 28B. For purposes of explanation, it will be assumed that the pump rotor 26 rotates clockwise as viewed in FIG. 2. So driven, a first inlet port 32A provides hydraulic fluid or oil to the first pumping chamber 28A and a first outlet port 34A exhausts the pressurized hydraulic fluid or oil from the first pumping chamber 28A. Likewise, a second inlet port 32B provides hydraulic fluid or oil into the second pumping chamber 28B and a second outlet port 34B exhausts the pressurized hydraulic fluid or oil from the second pumping chamber 28B. Rotation of the pump rotor 26 in the opposite direction, i.e., counter-clockwise when viewed in FIG. 2, will reverse the function and thus the designation of the inlet ports 332A and 32B and the outlet ports 34A and 34B as those familiar with vane pumps will readily appreciate.

The pump rotor 26 includes a plurality of, but preferably four as illustrated, equally circumferentially spaced axially extending and radially oriented slots 36 which each receive one of a like plurality of pump vanes 40. It will be appreciated the more or fewer slots 36 and pump vanes 40 may be utilized depending upon the design criteria of the vane pump 20. Any pressure generated by the vane pump 20 is routed by a passageway (not illustrated) to the center of the pump 20 to drive the pump vanes 40 radially outwardly to aid sealing. As the pump rotor 26 rotates, the pump vanes 40 slide radially in and out and contact the elliptical or oval wall 24 of the pump cavity 22 due to the centrifugal force and the centerline pressure generated by rotation of the rotor 26.

Clearly, in order for the vane pump 20 to provide pressurized hydraulic fluid or oil, a reasonably good seal must be maintained between the outer edges of the pump vanes 40 and the elliptical or oval wall 24 of the pump cavity 22. When the pump rotor 26 is rotating relatively rapidly, the necessary seal quality is achieved by centrifugal force and centerline pressure. At low speeds, pump efficiency may drop due to reduced centrifugal force and increased leakage. A worst case scenario is the startup of an unprimed pump. If sufficient suction cannot be generated in spite of the lack of oil or fluid, reduced operating speed, reduced centrifugal force and thus reduced seal quality, the vane pump may take an undesirably long time to prime.

Figure 3:
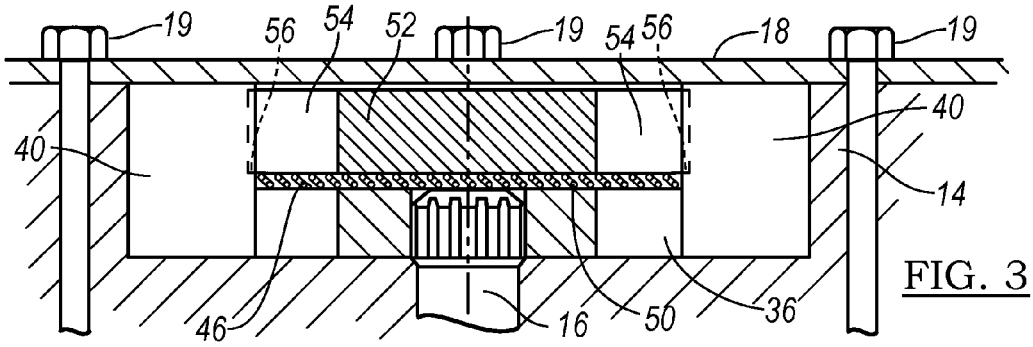
FIG. 3 is a fragmentary, sectional view of a self-priming vane pump according to the present invention taken along line 3-3 of FIG. 2.
Figure 4:
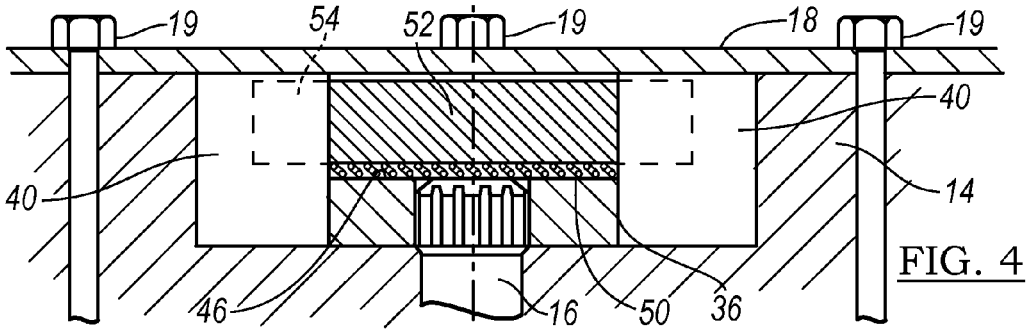
FIG. 4 is a fragmentary, sectional view of a self-priming vane pump according to the present invention taken along line 4-4 of FIG. 2.

Referring now to FIGS. 2, 3 and 4, the pump rotor 26 is, as noted, hollow and includes a stepped, inner wall 44 having a first, smaller diameter shoulder 46 adjacent the mid-point of its axial length. The shoulder receives and supports a nominally circular spring 50, i.e., a spring which is circular in its relaxed state. The spring 50 may be a garter spring or it may be an annulus of a resilient material such as an elastomer, e.g., rubber or neoprene. In fact, any suitably rugged and durable material or spring configuration capable of providing a radially outward biasing force to the pump vanes 40 is suitable. Preferably, the spring 50 is located axially so that it engages the axial midpoint of the pump vanes 40 in order to bias and maintain them parallel to the elliptical or oval wall 24 of the pump cavity 22.

Figure 5:
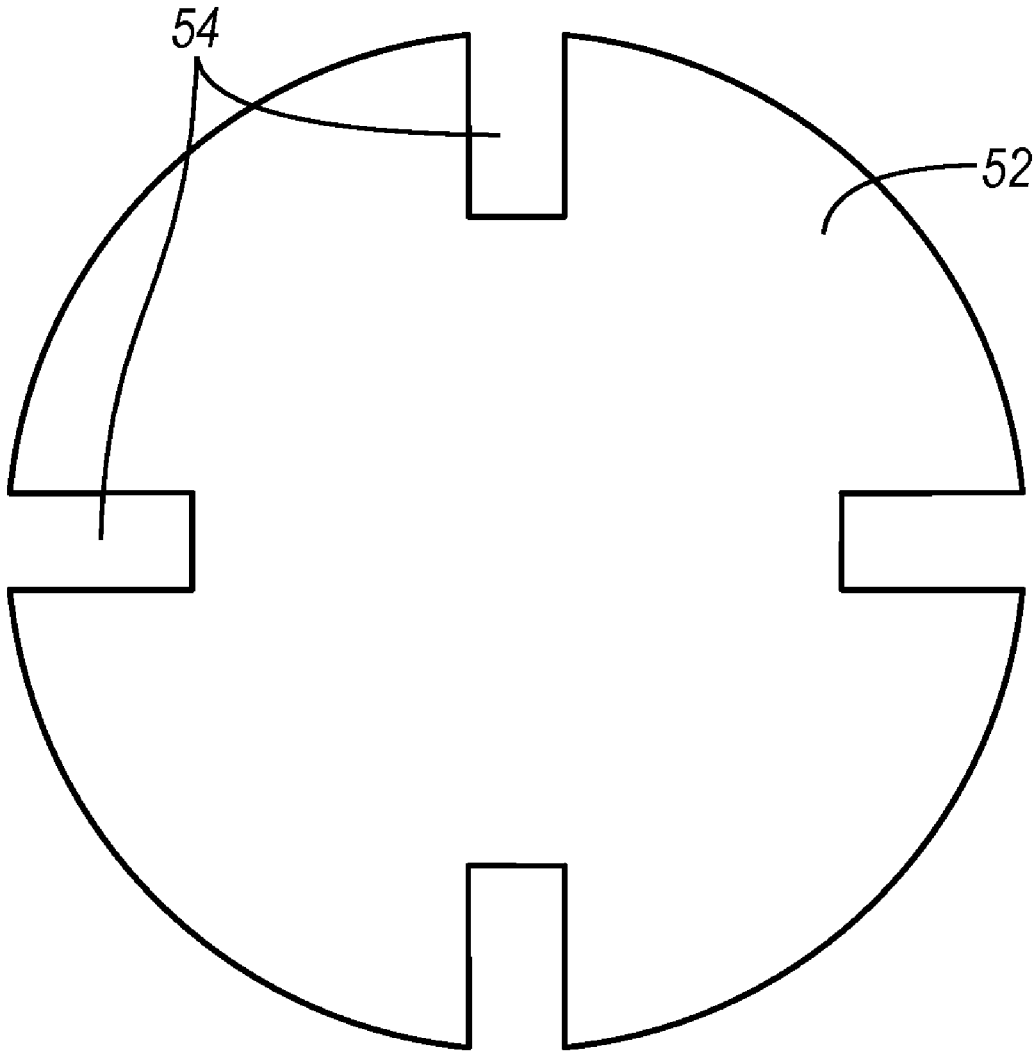
FIG. 5 is a plan view of a retaining collar of a self-priming vane pump according to the present invention.

Referring now to FIGS. 4 and 5, the spring 50 is retained in position on the shoulder 46 of the inner wall 44 and in contact with the inner edges of the pump vanes 40 by a disc or collar 52. The disc or collar 52 includes a plurality of, preferably four as illustrated, narrow slits 54 which accept and provide clearance for each of the pump vanes 40 as they reciprocate in the pump rotor 26. The disc or collar 52 will include a number of slits 54 at least equal to the number of pump vanes 40 and the slits 54 will be arranged similarly in order to provide clearance for the pump vanes 40. The disc or collar 52 is preferably a circular, relatively thick metal disc which has an outside diameter just slightly larger than the larger diameter portion of the stepped inner wall 44 of the pump rotor 26 such that it may be pressed in place to bottom out on a second, larger diameter shoulder 56.

Thus it will be appreciated that a vane pump 20 including a spring 50 according to the present invention exhibits improved seal quality both when the pump is not primed and when it is operating at low speeds due to the radially outwardly directed force imposed on the pump vanes 40 by the spring 50 which maintains them in close contact with the elliptical or oval wall 24 of the pump cavity 22.

The description of the invention is merely exemplary in nature and variations that do not depart from the gist of the invention are intended to be within the scope of the invention. Such variations are not to be regarded as a departure from the spirit and scope of the invention.

What is claimed is:

1. A vane pump comprising, in combination, a housing having an oval pump cavity and at least one inlet port and one outlet port communicating with said cavity, a rotor disposed within said cavity, said rotor defining a plurality of axially extending slots and a shoulder portion, a vane disposed for radial motion in each of said slots, and means disposed within said rotor for radially outwardly biasing said vanes, and wherein said shoulder portion of said rotor axially positions said means for radially outwardly biasing said vanes.

2. The vane pump of claim 1 wherein said means is a garter spring.

3. The vane pump of claim 1 wherein said means is a resilient annulus.

4. The vane pump of claim 1 wherein said rotor includes a drive shaft extending through said housing.

5. The vane pump of claim 1 further including a collar disposed within said rotor for axially positioning said means for radially outwardly biasing said vanes.

6. A self-priming vane pump comprising, in combination, a housing defining an oval pump cavity and at least one inlet port and one outlet port communicating with said cavity, a rotor disposed for rotation within said cavity, said rotor defining at least one axially extending slot and a shoulder portion, a vane disposed for radial motion in said slot, means disposed within said rotor for radially outwardly resiliently biasing said vane, and wherein said shoulder portion of said rotor retains said biasing means within said rotor.

7. The self-priming vane pump of claim 6 wherein said biasing means is a garter spring.

8. The self-priming vane pump of claim 6 wherein said biasing means is a resilient annulus.

9. The self-priming vane pump of claim 6 further including a drive shaft extending through said housing and connected to said rotor.

10. The self-priming vane pump of claim 6 further includes a collar disposed within said rotor for retaining said spring means within said rotor.

11. A self-priming vane pump comprising, in combination, a housing defining an elliptical pump cavity and at least one inlet port and at least one outlet port communicating with said cavity, a hollow rotor disposed for rotation within said cavity, said rotor defining at least one axially extending slot and a shoulder portion, a vane disposed for radial motion in each of said slots, spring means disposed within said hollow rotor adjacent to said shoulder portion of said hollow rotor for radially outwardly resiliently biasing said vanes, and a collar disposed within said hollow rotor adjacent to said spring means for axially positioning said spring means.

12. The self-priming vane pump of claim 11 wherein said spring means is a garter spring.

13. The self-priming vane pump of claim 11 wherein said spring means is a resilient annulus.

14. The self-priming vane pump of claim 11 wherein said hollow rotor includes a drive shaft extending through said housing.

15. The self-priming vane pump of claim 11 further including means for axially positioning said means for biasing.

16. The self-priming vane pump of claim 11 wherein said shoulder portion axially positions said spring means within said hollow rotor.

* * * * *